US005842243A

United States Patent [19]

Horvath et al.

[11] Patent Number: 5,842,243

[45] Date of Patent: Dec. 1, 1998

[54] MANUALLY PROPELLED POOL CLEANER

[75] Inventors: Tibor Horvath, Springfield; Joseph Porat; Giora Erlich, both of North Caldwell, all of N.J.

[73] Assignee: Aqua Products Inc., Cedar Grove, N.J.

[21] Appl. No.: 847,581

[22] Filed: Apr. 24, 1997

[51] Int. Cl.[6] ..... E04H 4/16

[52] U.S. Cl. ..... 15/1.7

[58] Field of Search ..... 15/1.7, 404

[56] References Cited

U.S. PATENT DOCUMENTS 3,979,788 9/1976 Strausak ..... 15/1.7

4,692,956 9/1987 Kassis ..... 15/1.7

*Primary Examiner*—Randall E. Chin

*Attorney, Agent, or Firm*—Abelman, Frayne & Schwab

[57] ABSTRACT

A self-contained, manually propelled pool cleaner moves on wheels positioned inboard of the housing, the wheels being supported by axles that extend laterally across the entire width of the housing and are secured at their ends to the side walls and along their length to the lower periphery of the front and rear walls to provide structural integrity and rigidity to the housing. The base plate is provided with pivoting brushes extending diagonally across the direction of travel to move debris towards the intake ports for entrainment in a disposable filter bag. A pivoting off-set connector permits the operator to control the direction of movement by axially twisting the handle while pushing or pulling the cleaner. Electrical power to operate the water pump(s) is supplied from an airtight floating battery case that is tethered to the pool cleaner.

23 Claims, 3 Drawing Sheets

MANUALLY PROPELLED POOL CLEANER

FIELD OF THE INVENTION

The invention relates to self-contained machines for cleaning the submerged surfaces of swimming pools and the like.

BACKGROUND OF THE INVENTION

A variety of devices have been constructed to clean the submerged surfaces of swimming pools to remove dirt, debris and algae. Owners of outdoor residential, municipal and commercial pools must remove debris such as leaves, twigs, small stones, sand, insects and other foreign matter that inevitably accumulates in the bottom of the pool. Indoor pools generally accumulate less dirt and debris, and the removal of algae and similar growth, along with foreign matter such as bandaids, buttons, hair pins and the like is necessary.

Completely automated pool cleaners have been developed that are self-propelled by electric motors and endless belt driving means, the path of which can be preprogrammed to cover the entire bottom and side walls of the pool. Because of the complexity of their construction and operation, these fully automatic pool cleaners are relatively expensive.

Portable pool and fountain vacuum systems have also been used for the necessary cleaning and maintenance of indoor and outdoor pools. These devices are usually mounted on a hand truck or other wheeled frame and include a pump and filter cartridge which must be attached to a flexible hose and then through a hollow section of pipe to a brush or molded head which is manually directed to contact the bottom and side walls of the pool. The pumps can be powered by electric motors or gasoline engines. The filter cartridge canisters and other parts of the assembly are typically fabricated from stainless steel and can be costly. Also, because of the need to move large volumes of water significant distances through flexible vacuum hoses and rigid pipes and their fittings, high capacity pumps and relatively powerful motors or gasoline engines are required. These systems require a relatively large amount of storage space for hoses, pipes, attachments and to pump and filter unit, and all must be moved to and from the pool. In addition to being bulky and labor intensive in their use, this type of pool vacuum cleaning system is also relatively expensive.

It is therefore an object of the present invention to provide a compact, reliable and yet relatively inexpensive apparatus for cleaning the submerged surfaces of a swimming pool, or the like, to remove large debris such as leaves and twigs, and one that will remove sand and dirt, and that will also dislodge and filter out surface growth, such as algae.

It is another object of the invention to provide a self-contained pool cleaning apparatus that includes cleaning means for dislodging foreign matter from the submerged surfaces of a pool, a vacuum pump that will draw the dirt, debris and dislodged foreign matter from concrete and tile surfaces of a pool and a filter that will retain the foreign matter removed from the pool surface until the apparatus is removed from the pool and can be cleaned.

It is yet another object of the invention to provide a manually-propelled pool cleaning apparatus that is self-contained and that can be moved across the bottom, vertical sidewalls and steps of a swimming pool with a minimum of physical exertion by the operator.

Another object of the invention is to provide a self-contained pool cleaning apparatus in which the filter medium is a bag constructed from an inexpensive synthetic fabric-like material of sufficient wet-strength and filtering capacity to permit its use in at least one complete cleaning of a large pool, and which can be disposed of when its filtering capacity has been reached.

It is also an object of this invention to provide a manually-propelled pool cleaning apparatus that is relatively light weight and easily transportable to and from the pool and that requires relatively little storage space.

It is yet another object of the invention to provide a self-contained pool cleaning apparatus in which the power is supplied by one or more batteries that are hermetically sealed in a floating container that is placed in the pool and tethered to the apparatus an electrical conductor cable.

It is also an object of this invention to provide a pool cleaning apparatus that requires no external pumps or filter tanks, requires no hoses or priming and eliminates the need to replace filter cartridges and clean filter bags.

SUMMARY OF THE INVENTION

The above objects and other advantages and benefits are obtained by a pool cleaning apparatus that is manually propelled and directed to contact the submerged bottom, sidewalls and steps of a pool where the apparatus comprises a generally rectilinear housing that is open at its base and which contains at least one pump for drawing water into the housing and, after passing it through a filter medium which retains dirt, debris and the like, expels the water from the housing through one or more openings in the top wall of the housing that is in communication with the discharges side of the pump. The discharge from the high flow-rate pumps creates a downwardly directed force which keeps the apparatus firmly on the pool surface being cleaned.

The base opening of the housing is covered by a base plate that is provided with a plurality of spaced intake openings communicating with the interior of the housing and a plurality of depending cleaning means aligned in an array and adapted to contact substantially the entire surface area of the pool that lies beneath the housing as the apparatus is moved across the surface.

The housing is supported by a plurality of wheels that are permanently positioned proximate the periphery of the base opening of the housing, and which are of a diameter that maintain the cleaning means in contact with the pool surface as the apparatus is moved about. The pole or rod that is used to manually propel the apparatus is, in a preferred embodiment, attached by a specially designed swivel fork pivot assembly that causes the apparatus to change direction in response to an axial turning, or torsional force applied to the pole or rod.

In accordance with principals that are well-known in the art, the apparatus is constructed with a negative buoyancy that is just below being neutral in the pool water, whether fresh or salt. When the pump is activated, the water is discharged through one or more openings in the top wall of the housing which openings are also provided with an upwardly extending nozzle to define a region of laminar flow. The force of the water discharged creates a downward force which has the effect of keeping the supporting wheels in contact with the surface of the pool to be cleaned. Since the force created by the discharge of the pump is normal to the surface being cleaned, the apparatus will retain a stable position on vertical as well as horizontal or sloped surfaces. The operator of the apparatus therefore is required to exert only so much effort or force as is required to move the apparatus across the bottom surfaces of the pool, which will be understood to be minimal, and only a slightly greater effort is required to move the apparatus along the vertical walls, the only difference being the weight of the pole or rod, less of which will be submerged, particularly at the shallow end of the pool.

DETAILED DESCRIPTION OF THE INVENTION

The apparatus of the invention and its method of operation and use will be further understood with reference to the figures in which like elements are referred by the same numbers.

Figure 1:
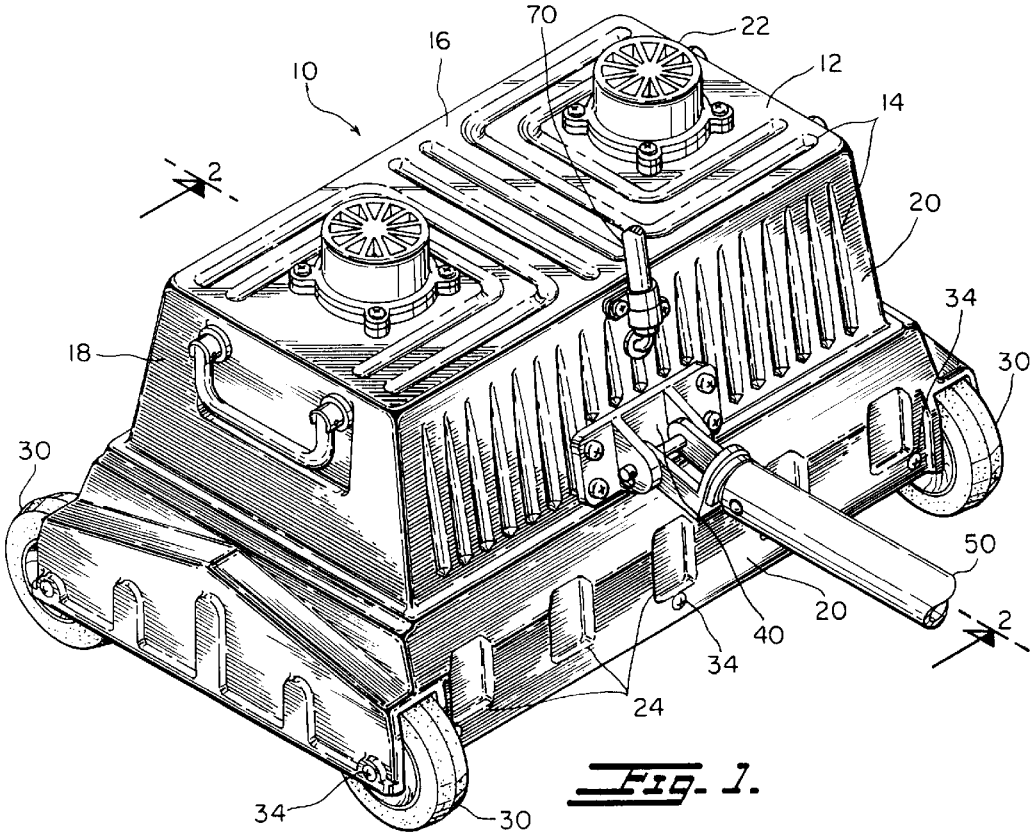
FIG. 1 is an isometric view of the apparatus of the invention which, for convenience, includes only a short segment of the propelling pole and a segment of the electrical conductor cable secured to the housing.

As illustrated in FIG. 1, the manually propelled pool cleaning apparatus 10 is comprised of housing 12 that can be conveniently fabricated by conventional molding processes employing polymers such as acrylonitrile-butadiene-styrene copolymer (ABS). The housing can be provided with decorative surface treatments 14 which can also serve as reinforcing members. The external appearance or configuration of the housing 12 can be designed on the basis of aesthetic considerations, and can be provided in a more hydrodynamically efficient, or streamlined design.

As will be appreciated by one skilled in the art, a generally rectilinear configuration, preferably with depending side walls and/or transverse walls that slope out at even a slight angle from the top to the base opening are most easily produced in a molding process. As a practical matter, the external configuration and design of the housing is dictated by the size and positioning of the pump(s) and filter means inside the housing. For convenience and the purposes of this disclosure, a generally rectilinear housing is illustrated. In the embodiment illustrated, the open base of the housing defines a generally rectangular opening measuring approximately 10 inches by 20 inches, and the height of the housing is approximately 12 inches.

For the purposes of this description, the housing 12 is defined by top wall 16 from which depend opposing side walls 18 and transverse walls 20. The top wall 16 is provided with at least one, and in the preferred embodiment of FIG. 1, a pair of discharge openings over which are affixed pump discharge nozzles 22. As will be explained in more detail below, the discharge nozzles 22 communicate with the discharge side of the water pump 60 located on the interior of the housing to provide a region of laminar flow.

Figure 2:
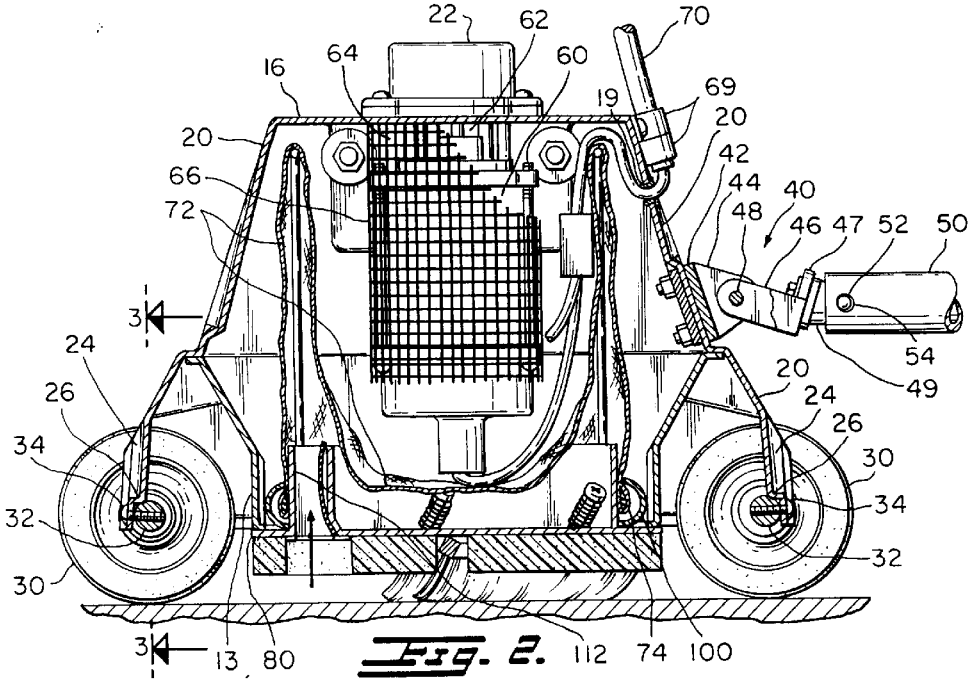
FIG. 2 is a cross-sectional view of the apparatus shown in FIG. 1 taken along section line 2—2.
Figure 3:
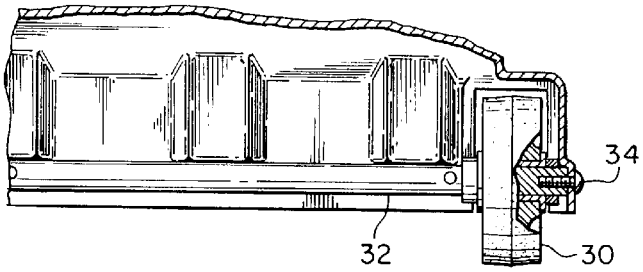
FIG. 3 is a sectional view of the apparatus shown in FIG. 2, partly in cross-section, illustrating the attachment of the wheel and axle to the housing, taken along section line 3—3.
Figure 4:
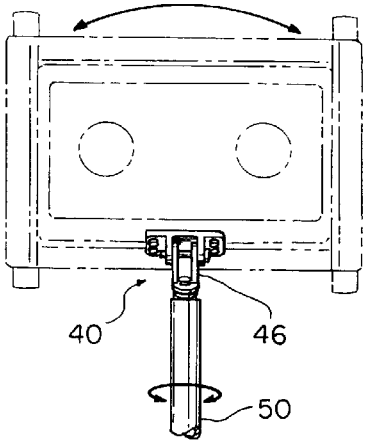
FIG. 4 is a top plan view of the apparatus in which the housing and wheels are shown in phantom, that schematically illustrates the effect on the direction of the apparatus of applying an axial twisting or torsional force to the propelling pole through the swivel fork pivot assembly.

In the preferred embodiment of the apparatus as illustrated in the figures, the wheels 30 are positioned inboard of the side walls 18. This configuration provides an added measure of protection for the wheels from side impact damage and firm wear and tear during their use in the pool as well as during movement of the apparatus outside of the pool and storage. However, the inboard positioning of the wheels interrupts the integrity of the lower periphery of the housing and it detracts from the mechanical strength of the housing. In accordance with a preferred embodiment of the invention, the axles upon which the wheels are mounted serve a dual function of providing a support for the wheels and also an equally important, but entirely different function of reinforcing the periphery of the housing. This dual function is accomplished by securing the side walls and the periphery of the transverse walls to the rigid axle members 32. As shown in the cross-section of FIG. 2, axle 32 is joined to transverse wall 20 by mechanical fastening means 34, which in this embodiment a self-tapping screw. As shown best in FIG. 1, a plurality of fasteners 34 are inserted through openings in transverse wall 20 to engage axle 32 and draw it up against the transverse wall. As shown in FIGS. 1 and 3, the side wall 18 is secured to the end of axle 32 by fastener 34. Axle 32 can be cut from rods of an engineering plastic, such as nylon or high density polyethylene, polyvinyl chloride (PVC), ABS, and the like, or it can be fabricated from stainless steel or other metal alloy that will not be adversely affected by exposure to salt or fresh water. As will be apparent to one of ordinary skill in the art, the function and desirable result achieved by the embodiment illustrated can also be accomplished using other means for fastening the rod to the transverse wall and the end walls. For example, circular metal spring clips (not shown) can be snapped around the axle at several locations and inserted through corresponding holes along the periphery of the transverse wall to join these two members. The end of axle 32 can be passed through a corresponding opening in the side wall and provided with a groove to receive a split washer or other fastening means to retain the side wall in alignment rigid with the end of the axle.

In order to facilitate the assembly of the axle to the transverse wall, to add additional rigidity to the assembly, and finally to insure that the weight of the housing and its internal elements are borne by the axles, an internal load bearing member is formed in the transverse walls to contact the axles. As best illustrated in FIG. 2, the several recessed areas 24 proximate the periphery of the transverse wall result in an interior ridge or lip which contacts a portion of the surface of axle 32 across its length. The inwardly projecting ridge 26 transfers the weight of the housing 12 to the axle 32 thereby avoiding undue stresses at the points of location of fasteners 34. This teaching of the means for reinforcing and supporting the housing on an integral internal load bearing member formed in the transverse wall by rigid attachment of the axle will provide one of ordinary skill in the art with a starting point for equivalent constructions without departing from the spirit and clear teachings of the invention. For example, housing 12 can be molded with a plurality of spaced apart projections on its interior surface, or a single continuous projection along its interior surface proximate the periphery of the transverse wall, configured to receive the cylindrical axle 32 in a snap-fit relation. These projections (not shown) can be semi-cylindrical or rectilinear in cross-section, the only requirement being that they can receive and provide support to the axle. By incorporating a snap-fit molded channel as an integral element in the transverse wall, the need for auxiliary fasteners can be eliminated from this area.

With continuing reference to FIGS. 1 and 2, handle 50 is attached to the housing by swivel fork assembly 40, which in this preferred embodiment is shown secured to a transverse wall. Swivel fork assembly 40 is constructed from bracket plate 42 having a pair of spaced apart standing lugs 44 to which is pivotally attached yolk 46 by means of pivot pin 48. An offset connecting rod 49 is joined to yolk cross-piece 47 at an angle that is offset from the perpendicular to the cross piece as measured along the axis of the yolk 46. When handle 50 is assembled to connector 49, a torsional or twisting force applied to handle 50 results in a turning force that is applied to the housing to effect a corresponding direction change to the right or to the left as the apparatus moves across the pool surface. This provides a significant mechanical advantage to the operator of the apparatus when he is working near the free end of pole 50. In the usual and anticipated method of using the apparatus, the individual will assume a position along one of the longer sides of a rectangular pool and push the apparatus away from him by moving the handle 50 through his hands. If it is assumed that the pool is 15 feet wide, and the pole is 15 feet long, the leverage available to the individual when the pole is fully extended is minimal. However, by grasping the end of the pole and applying a torsional or twisting force with one or both hands, that force results in a eccentric or offset force being applied to the housing 12 through the offset connecting rod 49, yolk 46 and bracket 42. Thus, the operator can twist the pole to the right to affect a change in the orientation of the housing and draw the apparatus back on a path which is offset to the right from the original path across the pool.

Again referring to FIGS. 1 and 2, the end of pole 50 and offset connector rod 49 are provided with a quick-release coupling means. In the embodiment illustrated, a pair of spring-loaded buttons 52 in rod 49 engage openings 54 in pole 50.

Returning the FIG. 2, at least one pump 60 is mounted on the interior of housing 12 with pump discharge 62 in communicating alignment with discharge nozzle 22. Pump intake 64 is completely surrounded by a rigid screen 66, for example, fabricated from stainless steel or nylon with a ⅛ inch mesh to protect the pump impeller blades (not shown) from stones or other debris which might inadvertently escape from the filter assembly. The selection of suitable AC or DC brushless pumps having appropriate capacities and performance specifications is known to those in the art and forms no part of this invention. Electrical cable 70 passes through a water-tight seal at orifice 19 in the housing to which it is secured by clamps 69. Electrical conductor cable 70 is also joined at one end (not shown) to a source of electrical power. A filter bag 72 surrounds pump 60, and the open mouth of the bag faces downward towards the pool surface.

Figure 5:
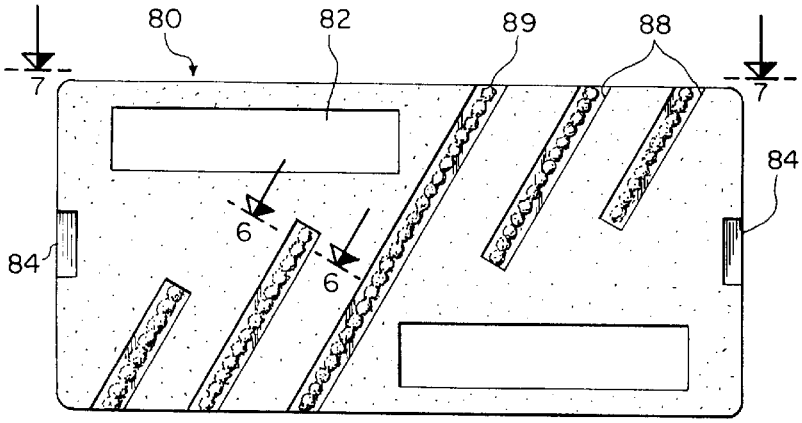
FIG. 5 is a plan view of a preferred embodiment of the base plate of the invention.

As shown in FIG. 5 the base plate 80 is provided with a plurality of spaced apart intake openings 82 which communicate with the interior of the housing. Base plate 80 is adapted to cover the open end of housing 12 and is secured in place, for example by "L" shaped clamps (not shown) which extend from housing 12 in to pockets 84. As illustrated in the preferred embodiment of FIG. 5, the intake openings 82 are offset with respect to both the transverse and longitudinal center lines of the base plate. However, the relative position of the intake openings insures that the entire surface area under the base plate will be covered by the intake openings as the apparatus is moved across the surface of the pool to be cleaned.

Figure 6:
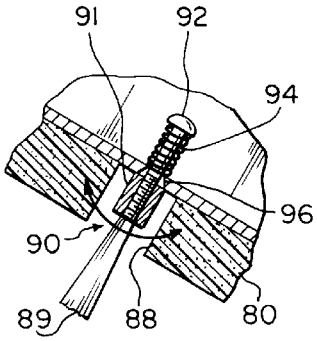
FIG. 6 is a cross-sectional view of a portion of one edge of the base plate of FIG. 5 in partial section showing the pivotal attachment of the brush assembly to the base plate.

With reference to FIGS. 5 and 6, it will seen that the base plate 80 is also provided with a plurality of recessed channels 88 into which are fitted brush assemblies 90. Brush assembly 90 is conveniently fabricated, for example, by molding a plurality of bristle tufts 89 into a continuous plastic base 91. As shown in FIG. 2, the bristles extend a distance below the base plate that is greater than the space between the base plate and surface to insure that the bristles will firmly contact the surface to be cleaned, even after some wear of the bristles has occurred. In order to prevent the entire apparatus from riding only upon the bristles, the brushes are pivotally mounted to tilt in response to a change in the direction of the apparatus. The pivot mounting can, in a preferred embodiment, be accomplished by providing the base plate with a plurality of chamfered holes 96 through which mechanical fasteners 92 pass to engage base 91. The chamfering faces downwardly towards the brush assembly 90 at an angle of approximately 60°. A resilient member, e.g., a spring 94, provides a force biasing the fastener and associated brush assembly in the direction away from the pool surface. When the brushes experience a lateral force resulting from movement across the surface, the entire brush assembly is able to respond by tilting in the channel away from the direction of movement. When the direction of the apparatus is reversed, the brush assembly pivots with respect to the base plate and the opposite edges of the brush engage the surface.

Figure 7:
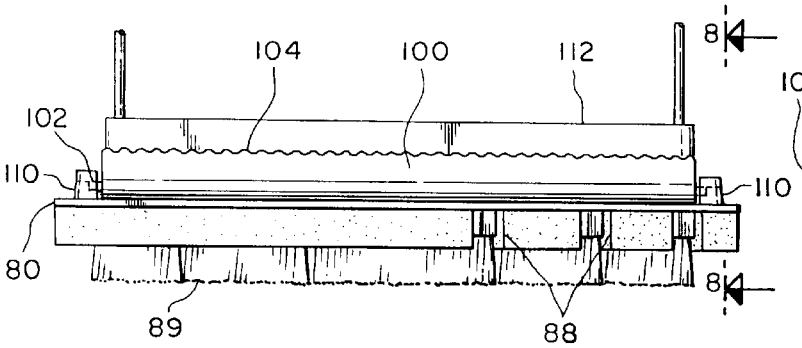
FIG. 7 is a side-elevational of the base plate of FIG. 5 and filter supporting assembly taken along section line 7—7.

As will be best appreciated by reference to FIGS. 5 and 7, the angular position, the spacing and the length of the brushes 90 in the recessed channels 88 insure that the entire surface over which the apparatus passes will be contacted by brush bristles 89. Moreover, the angular array, in a preferred embodiment makes an angle of 60° to the transverse edge of the base plate and also serves to move dirt and debris towards the respective intake openings 82 through which water is being drawn by the pump into the filter bag. It will be understood that in use, the apparatus must be propelled to overlap the prior path by approximately 50%, since the intake opening must be aft of the brushes during the cleaning pass.

In an especially preferred embodiment of the invention, the filter bag 72 is constructed from a fabric-like material that will render it economically disposable once it has become clogged with dirt and debris. Heretofore, it has been the practice in the industry to fabricate the filter bag from a costly woven material that has the requisite properties of durability, tear strength, resistance to rot and the like in order to provide a long useful life. The filter bags of the prior art must be emptied, flushed in clean water, and can require chemical treatment and soaking to remove decomposed animal matter (worms, insects, etc.) and organic waste that may have been left in the bag for an extended period after use.

In order to avoid the relatively high cost of the original filter bag and its eventual replacements, as well as the unpleasant and time-consuming task of emptying and cleaning permanent filter bags, a relatively inexpensive disposable filter bag of synthetic non-woven fabric is provided.

The disposable filter bag should have a life and capacity that will enable it to complete at least one cleaning of the pool with which the pool cleaner is to be used. The non-woven fabric must be capable of retaining its integrity when submerged for long periods of time in salt and fresh water, and must have a wet tear and tensile strength so that it does not separate when subjected to the force of water passing through and when impacted by sharp pieces of debris, such as twigs and stones.

A non-woven fabric produced from nylon filaments of a fine denier and having a filtering capability in the range of from about 10 to 50 microns when clean is suitable. A non-woven fabric produced from nylon filaments of about 40 denier and weighing about 45 grams per square yard has been found to be satisfactory. As the filter medium becomes clogged with dirt, particles down to 1 micron are retained. When the filter medium becomes so clogged that the flow rate is reduced to the point where debris is not removed from the surface to be cleaned, the bag is removed and discarded, and replaced with a new disposable bag. The non-woven synthetic nylon filter medium of the invention can be fabricated using the same designs and methods of construction used in producing the bags know to the prior art.

Figure 8:
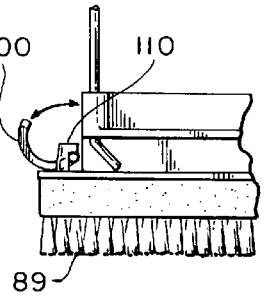
FIG. 8 is a partial plan view of the base plate and filter support assembly shown in FIG. 7 taken along section line 8—8.

With reference to FIGS. 2, 7 and 8, there is shown an improved mechanism for securing the elasticized hem 74 at the mouth of the filter bag 72 to the filter support assembly 112. Arcuate clamp member 100 is formed with contiguous tines 102 projecting longitudinally from its opposite ends. Tines 102 engage restraining posts 110 that are adapted for this purpose and project upwardly from the interior surface of base plate 80. The upper edge of clamp member 100 is formed with serrations 104 to assist in engaging and restraining the filter bag material. As best shown in the cross-sectional view of FIG. 2, when the base plate 80 is assembled to housing 12, the lower portion of interior transverse wall 13 engages the periphery of clamp member 100 to provide a clamping force against the filter bag and filter support assembly wall 112.

Figure 9:
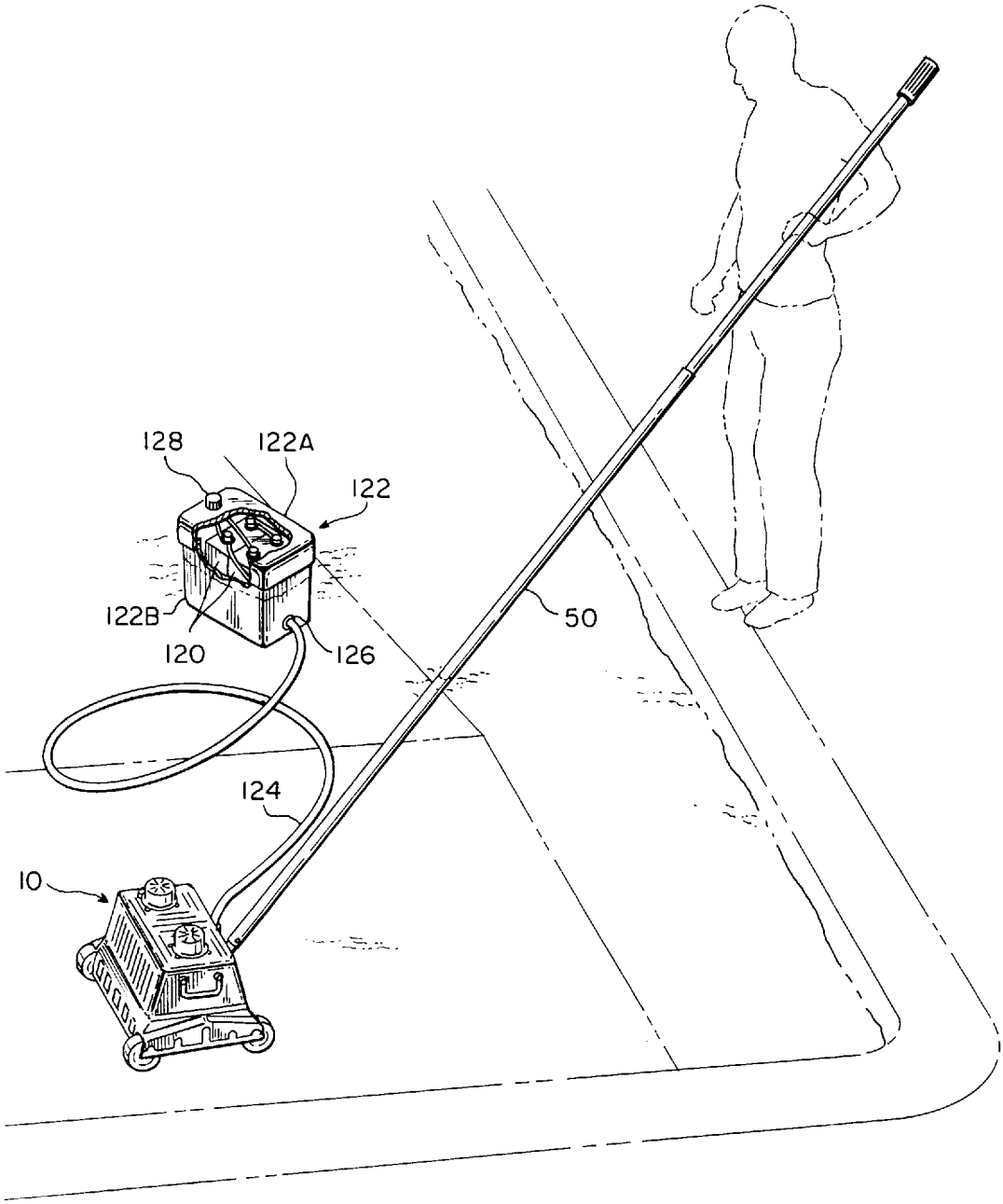
FIG. 9 is a pictorial view of the apparatus operated by a figure in phantom of FIG. 1 in combination with a buoyant battery container, the latter shown in a partly cutaway view.

In a further preferred embodiment of the invention illustrated in FIG. 9, the source of the electrical power required to operate the pump 60 in apparatus 10 is provided by one or more electrical storage batteries 120 that are located in a hermetically sealed buoyant container 122, conveniently molded in two pairs 122A and 122B from a non-conductive, corrosion and rust resistant polymeric composition. Electrical conductor cable 124 passes through a water-tight seal 126 to complete the battery connection at one end and is joined to apparatus 10. The cable 124 is preferably secured to the buoyant battery container 122 below the waterline to improve its stability. The container 122 is provided with a water-tight recharging connection 128 for use when the battery container is removed from the pool. The number and size of the batteries can be determined with respect to the power requirements of the pump and the size of, and time required to clean the pool.

The use of a buoyant battery container avoids the significant problem associated with the twisting and/or fouling of the power cables used with fully automatic pool cleaners, and also provides greater convenience and ease of use of the manually-propelled cleaning apparatus of the invention. The required length of floating electrical cable can be minimized to only a few yards more than the maximum depth of the pool. Use of battery power also eliminates the risk of electrical shock and the need for transformers and the like at the conventional power source.

Although various embodiments of the invention have been illustrated and described, it will be understood that these are by way of example and not limiting. Various modifications, which will be apparent to one skilled in the art, are within the scope of the invention as described in the claims which follow.

We claim:

1. An apparatus for cleaning the submerged surfaces of a swimming pool comprising (a) a housing formed by a top wall and four depending side walls, said side walls defining a base opening having a generally rectangular periphery, said top wall having one or more discharge openings communicating with the interior of the housing, (b) a base plate adapted to cover the base opening of the housing, said base plate provided with a plurality of spaced intake openings communicating with the interior of the housing and a plurality of cleaning means adapted to contact the surface of the pool, (c) a plurality of supporting wheels positioned proximate the base opening of the housing, (d) a handle pivotally mounted on the surface of the housing for manually moving the cleaning apparatus along the surface of the pool to be cleaned, (e) pump and filter means secured to the interior of the housing for drawing water through the intake openings of the base plate, filtering the water and expelling the water through the one or more discharge openings in the top wall and (f) electrical supply and control means for supplying electrical power to the pump.

2. The apparatus of claim 1 in which the intake openings in the base plate are generally rectangular and have a major axis which extends transverse to the intended direction of travel of the apparatus.

3. The apparatus of claim 1 in which the plurality of openings in the base plate extend transversely to substantially cover the surface area beneath the apparatus as it is moved across the pool surface.

4. The base plate of claim 1 in which the plurality of cleaning means are brushes.

5. The apparatus of claim 4 in which the brushes are partially mounted and extend in spaced-apart rows extending diagonally across the base plate.

6. The apparatus of claim 5 in which the rows of brushes are parallel and at least one end of each of said rows extends from the periphery of the housing.

7. The apparatus of claim 5 in which the rows of brushes are parallel and at least some of said rows terminate proximate one of said intake openings in the base plate.

8. The apparatus of claim 1 further comprising a pair of transverse axles extending between the side walls for mounting the wheels, each of said axles positioned proximate and secured to the periphery of a transverse wall of the housing.

9. The apparatus of claim 8 where the opposite ends of the axles are secured to the side walls of the housing and the wheels are mounted on the axles inboard of the side walls.

10. The apparatus of claim 1 in which the top wall includes two discharge openings.

11. The apparatus of claim 1 in which the handle is detachably mounted to a pivoting member secured to one of the transverse side walls.

12. The apparatus of claim 1 in which the handle is detachably secured to a generally U-shaped pivoting member, where the opposite ends of the U-shaped member is pivotally mounted on the side walls of the housing.

13. The apparatus of claim 1 in which the filter means comprises a disposable filter medium.

14. The apparatus of claim 13 in which the disposable filter medium is removably secured to a filter support member that is aligned with the base plate.

15. The apparatus of claim 13 in which the filter medium includes a filter bag formed from a synthetic fabric, said bag having an open mouth, said mouth having resilient elastic means at its periphery, the mouth of said bag adapted to engage a portion of the filter support member.

16. The apparatus of claim 13 in which the disposable filter medium is formed from non-woven synthetic fibers of fine denier capable of removing ten micron and larger particles when clean.

17. The apparatus of claim 13 in which the disposable filter medium is formed from non-woven nylon fabric.

18. The apparatus of claim 1 which further comprises at least one carrying handle secured to the housing for transporting the apparatus when it is not in the water.

19. The apparatus of claim 18 in which a pivoting carrying handle is mounted on each side wall.

20. The apparatus of claim 1 which further comprises a source of electrical energy in the form of one or more batteries that are hermetically sealed in a non-conductive buoyant battery container and an electrical conductor extending between the one or more batteries and the apparatus housing.

21. The apparatus of claim 20 in which the battery container is fabricated from a rust and corrosion resistant material.

22. The apparatus of claim 20 in which the electrical conductor extends from a surface of the battery container that is at or below the water line.

23. The apparatus of claim 20 in which the one or more batteries are rechargeable and the battery container includes a water-tight external connection for recharging said one or more batteries.

* * * * *